US005399817A

United States Patent [19]

Berges et al.

[11] Patent Number: 5,399,817

[45] Date of Patent: Mar. 21, 1995

[54] MUFFLER

[75] Inventors: Hanns-Peter Berges, Köln; Lothar Brenner, Bad Münstereifel-Eicherscheid; Hartmut Kriehn, Köln; Sascha Bauer, Auenwald, all of Germany

[73] Assignee: Leybold AG, Hanau, Germany

[21] Appl. No.: 39,477

[22] PCT Filed: Oct. 19, 1991

[86] PCT No.: PCT/EP91/01991

§ 371 Date: Apr. 26, 1993

§ 102(e) Date: Apr. 26, 1993

[87] PCT Pub. No.: WO92/08053

PCT Pub. Date: May 14, 1992

[30] Foreign Application Priority Data

Oct. 27, 1990 [DE] Germany ..... 40 34 253.0
Oct. 27, 1990 [DE] Germany ..... 9014883 U
Oct. 27, 1990 [DE] Germany ..... 9014888 U

[51] Int. Cl.[6] ..... F01N 7/08

[52] U.S. Cl. ..... 181/228; 181/230; 181/243; 181/265; 181/267; 417/312

[58] Field of Search ..... 181/227, 228, 229, 230, 181/231, 232, 243, 265, 267, 266, 273, 274, 276, 282; 285/49, 150, 219, 221; 417/312

[56] References Cited

U.S. PATENT DOCUMENTS 806,714 12/1905 Porter ..... 181/267
1,598,578 8/1926 Maxim ..... 181/265
3,032,139 5/1962 Gildone ..... 181/230
3,612,216 10/1971 Rieder ..... 181/265

FOREIGN PATENT DOCUMENTS 332837 11/1903 France .

*Primary Examiner*—Khanh Dang
*Attorney, Agent, or Firm*—Spencer, Frank & Schneider

[57] ABSTRACT

A muffler arrangement includes a muffler with an essentially cylindrical housing having a face end with a central entrance opening and at least one exit opening arranged other than centrally on the face end. Baffles are disposed within the housing, the baffles being concentrically arranged pipe cylinders which extend alternatingly into one another and are closed at one end, for effecting a multiple deflection of gases traveling from the central entrance opening to the at least one exit opening. A coupling structure is secured to the muffler housing, for carrying the muffler in an operating position. The coupling structure has a central passage for connecting the muffler to an exhaust outlet of a machine, and has an other than central channel, surrounding the central passage, for connection to an exhaust gas output conduit for outputting exhaust gases from the muffler arrangement. The at least one exit opening of the muffler is thereby connected by way of the other than central channel with the exhaust gas output conduit.

8 Claims, 2 Drawing Sheets

MUFFLER

BACKGROUND OF THE INVENTION

1. Field of the Invention

The invention relates to a muffler for the exhaust of a machine.

2. Background Information

Mufflers are generally disposed in the end region of exhaust gas conduits which discharge the gases leaving the exhaust of a machine (engine, pump or the like) into the open.

The following problem exists, for example, in connection with rotary vacuum pumps:

Rotary vacuum pumps include single shaft (sliding vane rotary pumps, rotary piston pumps, or the like) and dual shaft pumps (pumps equipped with pairs of rotors of the screw, Roots, or claw type, or the like) which additionally may be constructed to have one or several stages. In order to improve the suction capability of such pumps, it is possible to increase their number of revolutions. However, this also causes a considerable increase in noise development. In particular, dry running dual shaft vacuum pumps (suction chamber without oil) generate very high noise pressure levels in the region of their exhausts.

Vacuum pumps of the above-mentioned type are frequently employed in chemical or other processes (etching, vapor deposition processes, or the like). The gases sucked in by the vacuum pump in these cases are generally damaging to the environment. The exhaust of the vacuum pump is therefore connected to a permanently installed exhaust gas conduit which discharges the conveyed gases through gas washers or other cleaning systems into the open air. The gases extracted, in particular, from etching and vapor deposition processes are additionally often heavily laden with dust. Since in such processes it is customary to employ dry-running vacuum pumps, there exists the problem of dust deposits, particularly in the discharge region of the pump and in the connected exhaust gas conduits.

SUMMARY OF THE INVENTION

It is therefore the object of the present invention to configure a muffler in such a way that it can be accommodated in the vicinity of the machine whose noise emission is to be reduced, even if the exhaust gas conduits are permanently installed, and so that it can be easily exchanged without costly installation work at the exhaust gas conduits to make it possible to exchange it, for example, if there is a heavy dust load, without significant interruptions of the operation.

According to the invention this is accomplished in that the muffler is configured as a cartridge-type component. The cartridge configuration is known from oil filters. The cartridge housing has an essentially cylindrical configuration and has a closed end face. The intake and discharge openings are disposed in the second end face. Generally the oil entrance opening is in a central position and the oil discharge opening is other than central. The central oil entrance opening is formed by a threaded pipe socket. By means of this thread, the oil filter cartridge can be screwed to the assembly in which the oil to be filtered is disposed.

The configuration of the muffler as a cartridge-type component has the advantage that this component can be quickly exchanged without costly installation work at the exhaust gas conduits. Moreover, a compact structure results so that the muffler generally can still be accommodated within the outer machine housing.

Particularly advantageous is the use of the muffler according to the invention in the mentioned vacuum pumps which are employed in chemical or other processes (etching vapor deposition processes, or the like). The dust deposits accumulating in the discharge region of the pump can be removed without interruption of operations—for example by exchanging the muffler. There is the additional effect that the annoying dust preferably collects within the muffler according to the invention so that cleaning of the conduit guides disposed upstream and downstream of the muffler is substantially unnecessary.

BRIEF DESCRIPTION OF THE DRAWINGS

Further advantages and details of the invention will now be described with reference to embodiments thereof that are illustrated in FIGS. 1 to 3, in which.

BRIEF DESCRIPTION OF THE DRAWINGS

Figure 1:
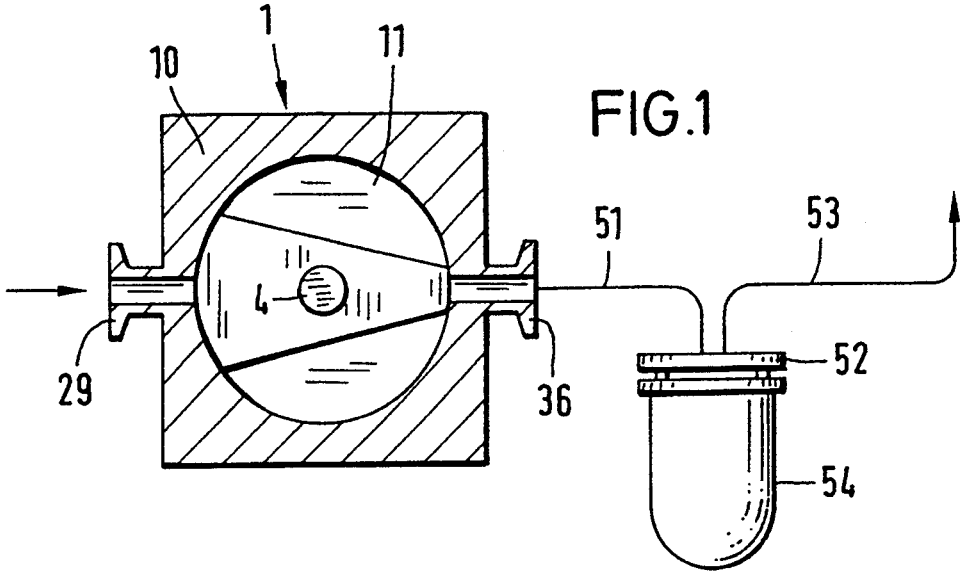
FIG. 1 is a schematic sketch of a vacuum pump equipped with a muffler.
Figure 3:
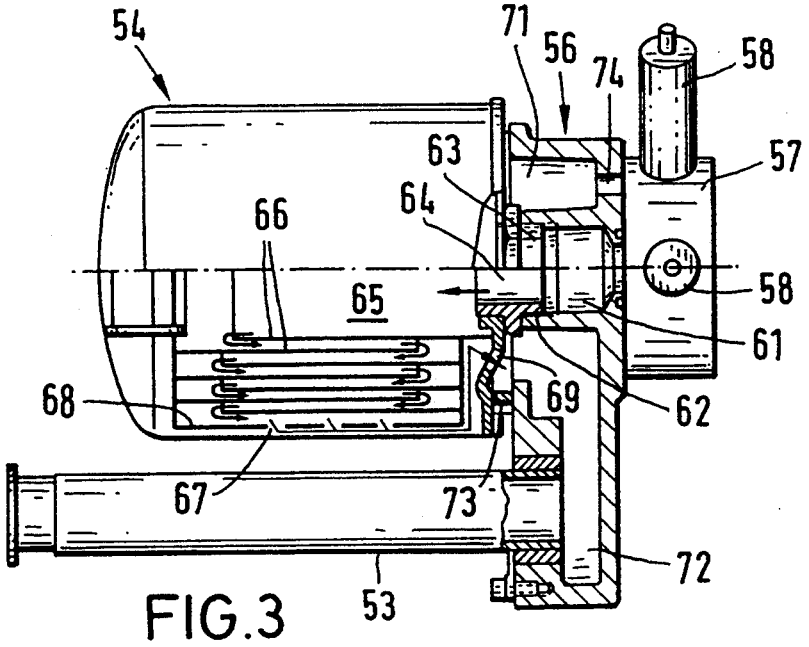
FIG. 3 is a partial sectional view of a muffler of the type discussed here.

The vacuum pump 1 shown schematically in FIG. 1 includes a rotor 4 disposed in the suction chamber 11 formed by a housing 10. Inlet and outlet of the vacuum pump are marked 29 and 36, respectively. Outlet 36 is followed by an exhaust gas conduit 51 which opens into a flange component 52. A continuing exhaust gas conduit 53 is also connected to flange component 52. A muffler 54 configured in the manner of a cartridge as shown, for example, in FIG. 3, is releasably fastened to flange component 52. This arrangement permits easy and quick exchange of the muffler without requiring costly disassembly and assembly work at exhaust gas conduits 51 and 53 themselves.

Figure 2:
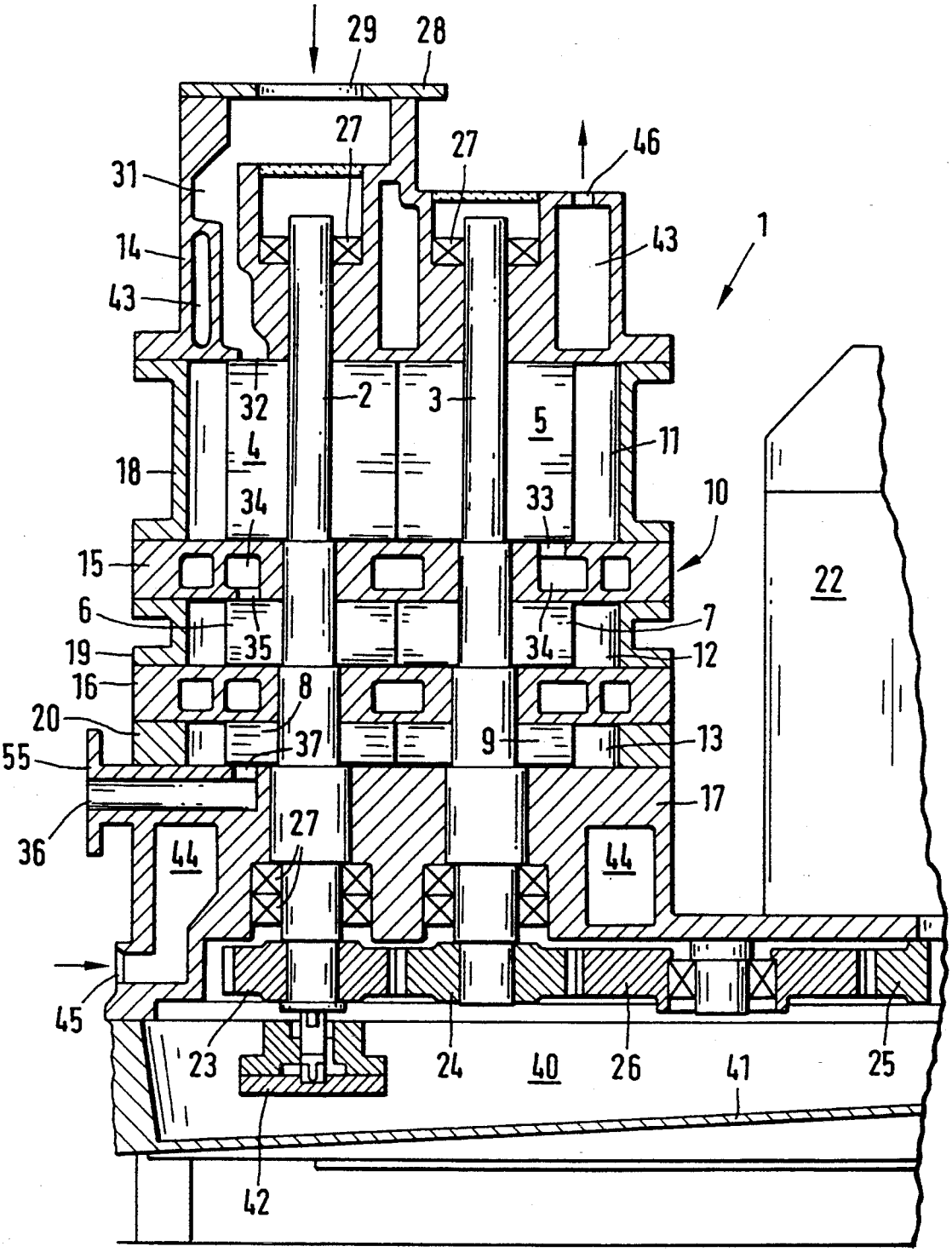
FIG.2 (PRIOR ART)
FIG. 2 depicts a vacuum pump equipped with rotor pairs of the claw type in which the use of the muffler according to the invention has particular advantages.

The pump shown in FIG. 2 is a three-stage vacuum pump 1 that is equipped with two shafts 2 and 3 and with three pairs of rotors 4, 5 and 6, 7 and 8, 9, respectively. The axial length of the rotors decreases from the suction side to the pressure side. The rotary pistons are of the claw type (Northey, see, for example, Published European Patent Application EU-A-290,662) and rotate in suction chambers 11, 12 and 13 formed by plates 14 to 17 and housing rings 18 to 20.

Shafts 2 and 3 are arranged vertically. This also applies for a drive motor 22 disposed next to the pump housing. Below the lower bearing plate 17, shafts 2 and 3 are equipped with gears 23 and 24 of identical diameter which serve to synchronize the movement of rotor pairs 4, 5 and 6, 7 and 8, 9, respectively. Drive motor 22 is also provided with a gear 25 at its underside. The driving connection is established by a further gear 26 which is in engagement with gears 24 and 25.

In the upper bearing plate 14 and in the lower bearing plate 17, shafts 2 and 3 are supported by way of roller bearings 27. The upper bearing plate 14 is equipped with a horizontally arranged connecting flange 28 which constitutes the inlet 29 of the pump. At the end face (opening 32) an inlet channel 31 opens into the suction chamber 11 of the first stage. The outlet opening at the end face of the first stage is marked 33 and leads into a connecting channel 34. The connecting channel 34 disposed in plate 15 is in communication with the inlet opening 35 of the second stage. Bearing plate 16 is configured correspondingly. Below the lowermost (third) pump stage there is disposed an outlet 36 which is in communication with the end face outlet opening 37 in lower bearing plate 17. In dry running pumps of this type, the above-described problems (noise development, dust deposits in the exhaust gas conduits) frequently exist to a particular degree. The invention substantially eliminates them.

A chamber 40 containing oil is disposed below the system composed of pump housing and motor. It is formed by a common shaft cradle 41. An oil pump 42 connected with shaft 2 extends into this shaft cradle 41. Lubrication channels, not shown individually, extend from the oil pump to the locations of the pump (bearing, points of engagement of gears 23 to 26, shaft sealing rings, or the like) which require lubrication with oil.

The illustrated embodiment of the three-stage dual-shaft vacuum pump is cooled with water. For this purpose, cooling water channels 43 and 44 are provided in lateral plates 14 and 17. Cooling water inlet and outlet are marked 45 and 46. Cooling water inlet 45 is disposed at the lowermost point of channel system 43, 44 so that it is easy to discharge the cooling water and complete emptying is ensured.

The discharge opening 36 of pump 1 is formed by a connecting pipe socket 55 which is equipped with a coupling member 56 to which in turn muffler 54 is releasably fastened. Muffler 54, coupling member 56 as well as an intermediate member 57 that can be inserted between coupling member 56 and connecting pipe socket 55 if desired are shown enlarged in FIG. 3. During operation of pump 1, coupling member 56 and connecting pipe socket 55 are connected with one another, either directly or by way of intermediate member 57. Intermediate member 57 serves to accommodate sensors 58, for example pressure sensors, whose operation will be described below. Gas type sensors may also be disposed at this location.

Coupling member 56 is provided with a central passage opening 61 which is partially equipped—on the side of the muffler—with an internal thread 62. A pipe socket 63 equipped with a corresponding external thread can be screwed into this thread 62 and simultaneously forms the entrance 64 to muffler 54. Entrance opening 64 is followed by a central interior chamber 65 that is surrounded by concentric baffle sheets 66. These are concentrically arranged, alternatingly meshing tubular cylinders that are closed on one side and cause the passing gases to be deflected several times (see the drawn arrows). The outer cylinder is equipped with lateral openings 67 so that the gases reach an outer annular chamber 68. This outer annular chamber 68 is in communication with one or several other than central discharge openings 69.

Discharge openings 69 are associated with a channel, preferably an annular channel 71, that is open toward the muffler and is disposed within coupling member 56. This channel is provided with a radially widened portion 72 to which is connected the outgoing exhaust gas conduit 53. In order to externally seal the muffler 54 against coupling member 56, a peripheral sealing ring 73 is provided which is arranged concentrically around pipe socket 63. The flange member 52 and the muffler 54 according to FIG. 1 are also advisably configured in the same manner as coupling member 56 and muffler 54 of FIG. 3.

In the illustrated embodiments, the exhaust gas travels from the pump outlet (36) into the interior (65) of the muffler (54). The subsequent, repeated deflection produces the desired sound attenuation. Then the exhaust gases exit from the discharge openings (69) and travel through the annular channel (71) in the coupling member (56) into the exhaust gas conduit (53).

As already mentioned, an intermediate member selectively installed between coupling member (56) and discharge pipe socket (55) serves to accommodate sensors (58). In the embodiment according to FIG. 3, a sensor (58) is in communication with the muffler entrance region. In the case of dust deposits in the muffler (54) the flow resistance increases which results in increased pressure in the entrance region of the muffler. With the aid of the pressure sensor it is then possible to monitor the load on the muffler (54) from deposits.

In the embodiment according to FIG. 3, another pressure sensor (58) is shown which is in communication by way of a bore (74) with the discharge region of the muffler (54). If two pressure sensors (58) are employed in this manner, it is possible to observe the dust load on the muffler (54) by observing the difference between the pressures recorded by the sensors.

We claim:

1. A muffler system comprising:

a muffler comprising an essentially cylindrical housing having a face end with a central entrance opening and at least one exit opening arranged other than centrally on the face end, and baffles, disposed within the housing, the baffles comprising concentrically arranged pipe cylinders which extend alternatingly into one another and are closed at one end, the baffles for effecting a multiple deflection of gases traveling from the central entrance opening to the at least one exit opening;

coupling means, secured to the muffler housing, for carrying the muffler in an operating position, the coupling means having a central passage opening for connecting said central entrance opening the muffler to an exhaust outlet of a machine, and having an annular channel, disposed within said coupling means and surrounding the central passage opening, for connection to an exhaust gas output conduit for outputting exhaust gases from the muffler system, wherein the at least one exit opening of the muffler is in communication with the exhaust gas output conduit through said annular channel.

2. A muffler system according to claim 1, wherein the central entrance opening of the muffler has an associated pipe socket equipped with an external thread, and the central passage opening in the coupling means is equipped with an internal thread.

3. A muffler system according to claim 2, further comprising a peripheral sealing ring arranged concentrically around the pipe socket for sealing an exterior of the muffler against the coupling means.

4. A muffler system according to claim 1, further comprising at least one pressure sensor associated with the central entrance opening of the muffler for monitoring the dust load on the muffler.

5. A muffler system according to claim 4, further comprising an intermediate member, disposed between the coupling means and the exhaust outlet of the machine, for holding the at least one pressure sensor.

6. A muffler system according to claim 1, further comprising at least one pressure sensor associated with each of the central entrance opening and the at least one exit opening of the muffler, respectively for monitoring the dust load on the muffler.

7. A muffler system according to claim 1, wherein said machine is a rotary vacuum pump.

8. A muffler system according to claim 7, wherein the pump comprises:

a pump housing having at least one suction chamber, the pump housing having an inlet and an outlet; and at least one rotor disposed in the at least one suction chamber;

wherein the coupling means of the muffler system is connected to the pump housing outlet.

* * * * *